US007077765B2

(12) United States Patent
Grossmeyer et al.

(10) Patent No.: US 7,077,765 B2
(45) Date of Patent: Jul. 18, 2006

(54) LIGHT-BASED GOLF SWING TRAINER

(76) Inventors: Mark Grossmeyer, W68 N328 Palmetto Ct., Cedarburg, WI (US) 53012; James Butts, 1789 Kettering Ridge Rd., Richfield, WI (US) 53076

( * ) Notice: Subject to any disclaimer, the term of this patent is extended or adjusted under 35 U.S.C. 154(b) by 0 days.

(21) Appl. No.: 10/885,367

(22) Filed: Jul. 6, 2004

(65) Prior Publication Data

US 2005/0009617 A1 Jan. 13, 2005

Related U.S. Application Data

(60) Provisional application No. 60/485,428, filed on Jul. 8, 2003.

(51) Int. Cl.
*A63B 69/36* (2006.01)

(52) U.S. Cl. ..... 473/409; 473/220

(58) Field of Classification Search ..... 473/409, 473/219–221, 223, 231, 237, 257, 278
See application file for complete search history.

(56) References Cited

U.S. PATENT DOCUMENTS

| | | | | |
|---|---|---|---|---|
| 2,804,306 | A * | 8/1957 | Conkling et al. | 473/237 |
| 3,037,778 | A * | 6/1962 | Conkling et al. | 473/228 |
| 3,070,373 | A * | 12/1962 | Mathews et al. | 473/220 |
| 3,311,377 | A * | 3/1967 | Holbus | 473/237 |
| 3,411,789 | A * | 11/1968 | Wariner | 473/237 |
| 3,687,459 | A * | 8/1972 | Swords | 473/237 |
| 3,992,013 | A * | 11/1976 | Golden | 473/409 |
| 5,120,064 | A * | 6/1992 | Cerami | 473/237 |
| 5,590,882 | A * | 1/1997 | Todd | 473/218 |
| 5,910,053 | A * | 6/1999 | Scalise | 473/257 |
| 5,954,592 | A * | 9/1999 | Laffer et al. | 473/220 |
| 6,361,449 | B1 * | 3/2002 | Holly | 473/237 |
| 6,485,374 | B1 * | 11/2002 | Myerscough | 473/222 |
| 6,913,544 | B1 * | 7/2005 | Tiffin | 473/278 |
| 2003/0013539 | A1 * | 1/2003 | Scott et al. | 473/251 |
| 2003/0087708 | A1 * | 5/2003 | Tiffin | 473/237 |
| 2003/0114237 | A1 * | 6/2003 | Boatner | 473/220 |
| 2003/0130055 | A1 * | 7/2003 | Townsend II | 473/278 |
| 2003/0190972 | A1 * | 10/2003 | Townsend, II | 473/278 |
| 2003/0216189 | A1 * | 11/2003 | Tiffin | 473/237 |
| 2004/0162155 | A1 * | 8/2004 | Sear | 473/278 |
| 2004/0209700 | A1 * | 10/2004 | Tiffin | 473/237 |
| 2005/0009617 | A1 * | 1/2005 | Grossmeyer et al. | 473/220 |

* cited by examiner

*Primary Examiner*—Raleigh W. Chiu
(74) *Attorney, Agent, or Firm*—Boyle Fredrickson Newholm Stein & Gratz S.C.

(57) ABSTRACT

A golf swing training device includes a pad having a light-reactive material on one side of the pad, and an indicator having a light source capable of striking the light-reactive material on the pad and creating a visual representation of the light on the pad. The pad includes printed indicia on the light-reactive material in order to illustrate the proper alignment and path for a putting stroke. An individual can place a golf ball on the pad and attach the indicator to the putter, and perform a putting stroke to strike the golf ball on the pad. The movement path of the putter head over the pad is visually illustrated by the reaction of the light source with the light-reactive material such that the individual can compare the actual putting stroke indicated by the light source path on the pad to the printed proper path indicia for the putting stroke. The visual representation of the actual path fades in a short amount of time such that the individual can perform subsequent putting strokes in order to improve the correspondence between the actual putting stroke and the optimal stroke represented on the pad.

7 Claims, 4 Drawing Sheets

LIGHT-BASED GOLF SWING TRAINER

CROSS REFERENCE TO RELATED APPLICATIONS

This application claims priority from U.S. Provisional Patent Application Ser. No. 60/485,428, which was filed on Jul. 8, 2003.

FIELD OF THE INVENTION

The present invention relates to golf training devices, and more specifically to a light-based golf swing training device.

BACKGROUND OF THE INVENTION

In order for an individual to improve his or her skills at the game of golf, a variety of different teaching and practice methods and devices have been developed. These methods and devices focus on various aspects of the golf swing, both in striking the ball from tee to green and in putting the ball on the green. However, due to the fact that strokes made on the green or putting surface typically account for more than 40% of the overall strokes for any given player, an individual wishing to become proficient at the game of golf must practice the putting stroke.

While the putting stroke is at least as important as the overall golf swing, the devices available for practicing the putting stroke are somewhat limited in their ability to provide a proper "feel" for a proper putting stroke. This is due to the popular notion that the putting stroke, being just a simple pendulum movement, requires only practice to develop an effective putting stroke. Further, of those putting stroke aids available, the majority of aids focus on the alignment of the player with the ball in order to attempt to ensure that the ball is struck in the desired direction when contacted by the putter. These devices address the initial alignment and setup for the putting stroke, but do not provide feedback regarding the motion performed by the individual during the stroke.

Therefore, it is desirable to develop a putting stroke aid or trainer that incorporates the functions of providing an individual with assistance in properly aligning the putter head with the ball prior to the stroke, and giving the individual feedback regarding the actual stroke after the ball has been struck by the putter. Further, the device should be easy to use and capable of repeated uses without damaging or wearing out the device.

SUMMARY OF THE INVENTION

It is a primary aspect of the present invention to provide a putting stroke training aid that enables an individual to obtain assistance in proper alignment for a putting stroke, as well as to receive a comparison of the actual motion of the individual's putting stroke relative to the proper motion for such a stroke. The training aid includes an alignment pad that can be positioned on a flat surface and on which a golf ball can be positioned. The pad includes an upper surface that is formed of an indicating material that has alignment indicia printed or otherwise disposed thereon. The printed indicia form a line to illustrate the proper path for a putter head during a putting stroke. A golf ball is positioned on the line defined by the printed indicia illustrating the proper stroke path, and is adapted to be struck by a user practicing a putting swing using the putting stroke training aid.

The training aid also includes an indicator that is attachable to a putter head. The indicator interacts with the indicating material forming the upper surface of the pad in order to provide a visual representation of the actual path the putter head has taken during the putting stroke. This enables the individual to compare the actual path of the putter head to the ideal or proper path illustrated by the printed indicia on the pad. The visual representation of the actual path created on the indicating material remains visible for a sufficient time to show the correspondence or lack thereof between the actual putting stroke and the proper putting stroke path. However, the visual representation on the pad also fades relatively quickly such that the representation of the actual stroke path completely disappears in order to allow the indicator be utilized with the pad to illustrate multiple subsequent putting stroke paths on the material.

According to another aspect of present invention, the indicator can be provided with a number of different types of securing devices in order to releasably secure the indicator to an actual putter head. The securing device enables the indicator to be attached to the putter head securely during use of the training aid in providing a visual representation of a putting stroke on the pad, and can also be easily disengaged from the putter head in order to enable the putter to be utilized in normal play for a round of golf. Further, the indicator has a small and simple construction and is light in weight, such that when the indicator is attached to the putter head, the presence of the indicator does not affect the movement of the putter in the individual's hands so as to maintain a realistic feel for the actual putting stroke.

According to still another aspect of the present invention, the pad including the indicating material is formed to be flexible such that the pad can be rolled, folded or otherwise deformed for storage. The pad can also include a lower surface formed of a material different from that of the upper surface in order to provide a more stable pad for use with the training aid.

Other aspects, advantages and features of the present invention will be made apparent from the following detailed description taken together with the drawing figures.

BRIEF DESCRIPTION OF THE INVENTION

The drawings illustrate the best most currently contemplated of practicing the present invention.

DETAILED DESCRIPTION OF THE INVENTION

Figure 1:
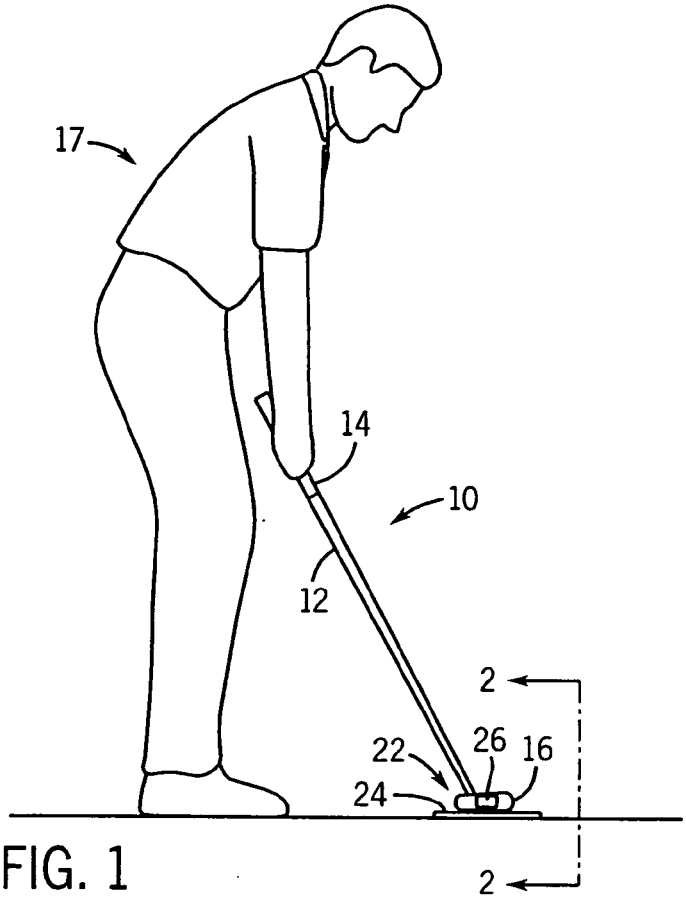
FIG. 1 is schematic elevation view of an individual utilizing a golf swing training aid constructed according to the present invention.

With reference now to the drawing figures in which like reference numerals designate like parts throughout the disclosure, a putter utilized in playing a game of golf is illustrated generally at 10 in FIG. 1. The putter 10 includes a shaft 12, a handle 14 disposed at one end of the shaft 12 and a putter head 16 disposed on a shaft 12 opposite the handle 14. In utilizing the putter 10 to perform a stroke, an individual 17 grasps the handle 14 and moves the putter 10 in a generally pendulum-like fashion to simulate a putting stroke. If it is desired to actually strike a ball, the putter 10 may be used to strike a golf ball 18. The shape of the putter head 16 can vary greatly depending upon the particular type and style of putter 10, but each putter head 16 includes a ball striking surface 20 (FIG. 2) that is used to strike the golf ball 18. The striking surface 20 is generally flat, and may be formed of a single or multiple materials, and may also include inserts which can provide various benefits to the ability of the striking surface 20 to strike the golf ball 18 in the intended manner.

In order to train an individual utilizing the putter 10 to strike a golf ball in a consistent manner flush against the ball striking surface 20 and in the proper direction, the putter 10 is utilized in conjunction with a putting stroke training aid 22 in accordance with the present invention. The training aid 22 includes a pad 24 and an indicator 26 that is releasably secured to the putter head 16.

Figure 2:
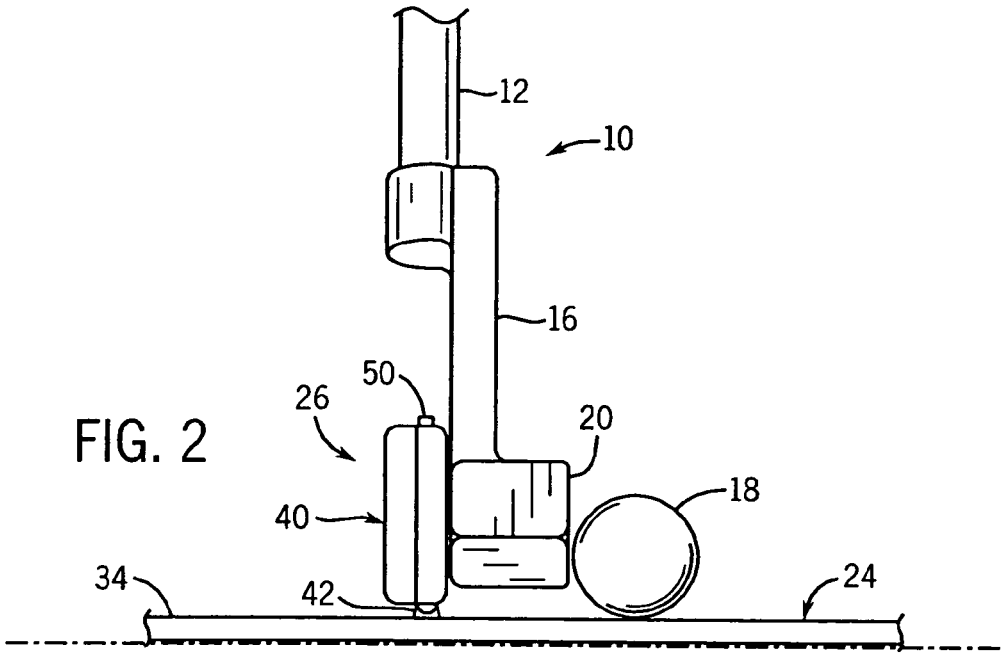
FIG. 2 is an enlarged partial side elevation view with reference to line 2—2 of FIG. 1.
Figure 3:
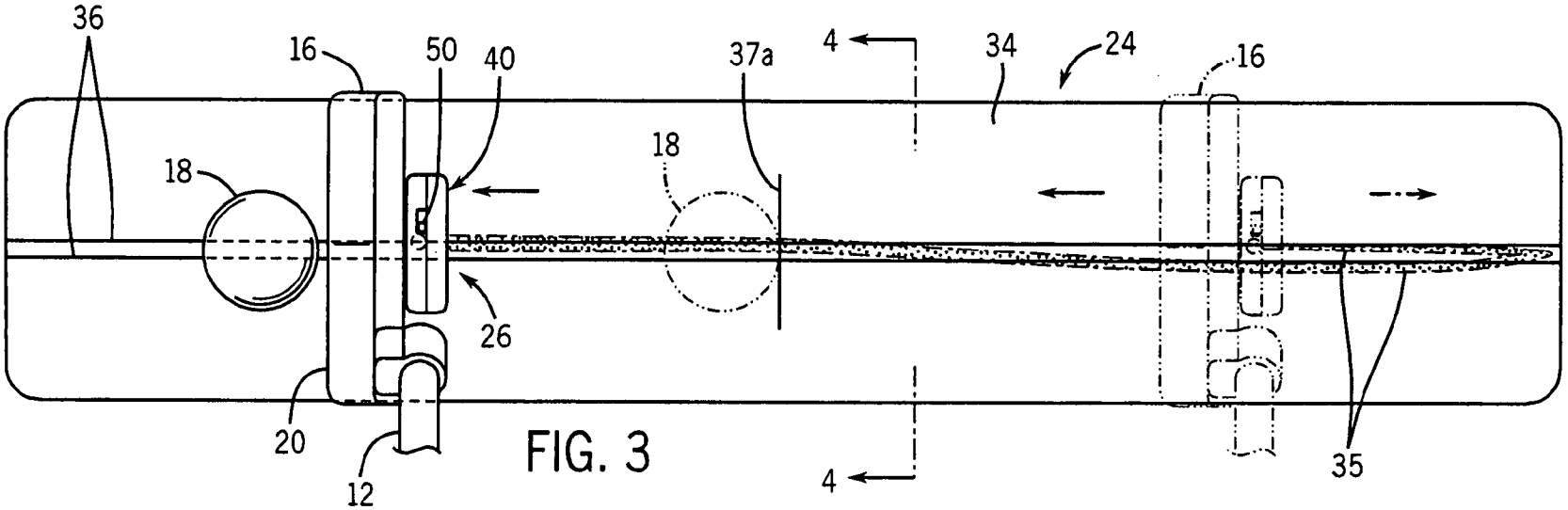
FIG. 3 is a top plan view of the training aid of FIG. 1.
Figure 4:
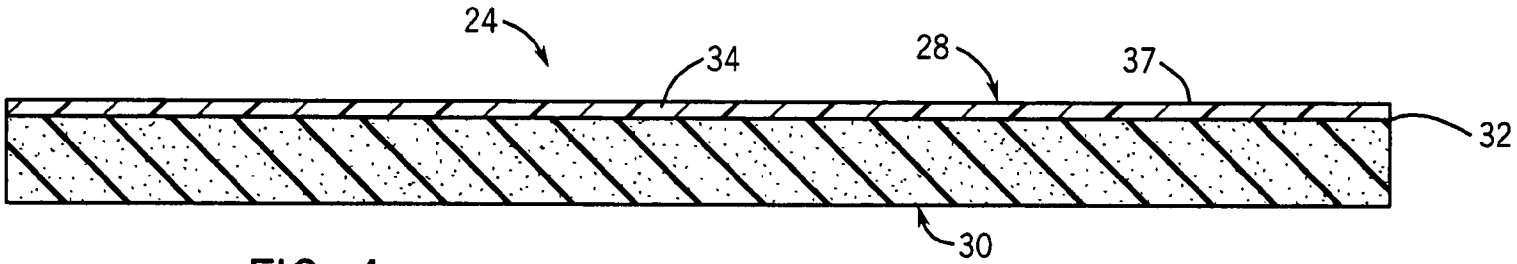
FIG. 4 is a cross-sectional view along line 4—4 of FIG. 3.
Figure 5:
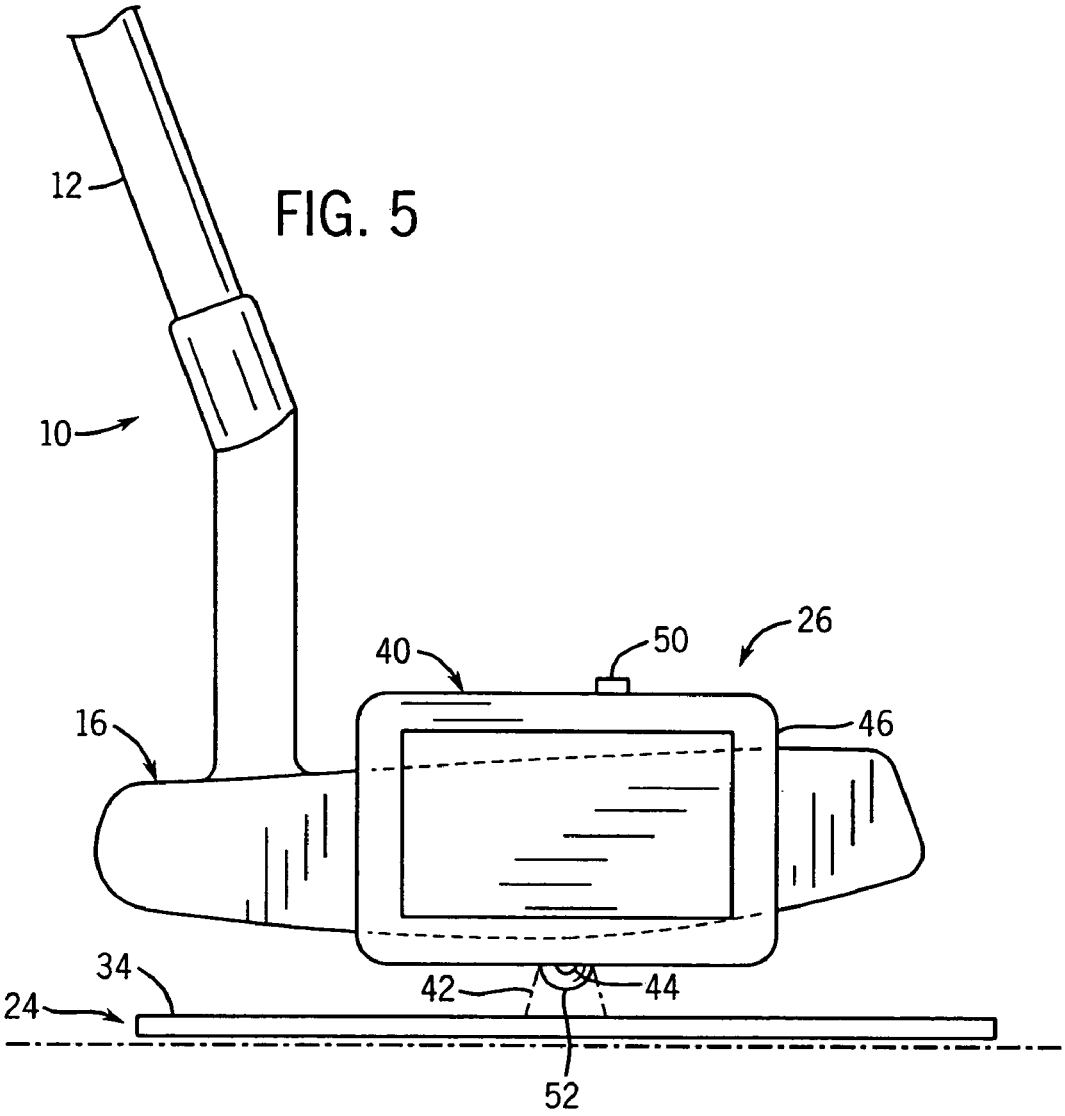
FIG. 5 is an enlarged partial rear elevation view of an indicator and pad incorporated in the training aid of FIG. 1.
Figure 6:
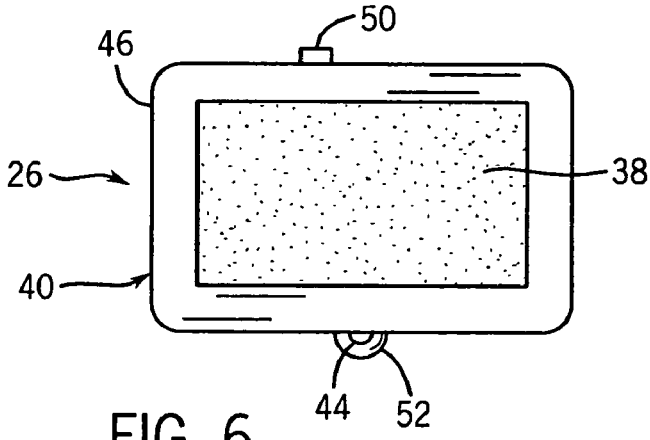
FIG. 6 is a front elevation view of the indicator of FIG. 5.

Referring now to FIGS. 2–4, the pad 24 can be any desired shape or size, but is preferably generally rectangular in shape, with a width of about six (6) inches and a length of about twenty-four (24) inches to allow for a variety of putting strokes to be practiced. In a particularly preferred embodiment, the pad 24 is formed with an upper member 28 and a lower member 30 joined to one another by any suitable bonding or securing means such as an adhesive 32. However, the pad 24 can also be formed solely from the upper member 28. The lower member 30 is formed of a flexible, and preferably high-friction material such as a foamed thermoplastic that can be positioned on a flat surface on which the training aid 22 is to be utilized. The thickness of the lower member 30 can vary as desired, but is preferably between ⅛ and ¼ inches in order to maintain the upper member 28 of the pad 24 close to the ground to provide a realistic feel to the putting stroke performed when utilizing the training aid 22.

The upper member 28 includes or is preferably formed of an indicating material 34 that is capable of visually illustrating the path the putter head 16 takes when the putter 10 is utilized to strike the golf ball 18 resting on the upper member 28. In a preferred embodiment, the indicating material 34 is a phosphorescent or photoluminescent material that, when contacted by a light source, is energized when exposed to a light source and presents a visual representation 35 of the path of the light source over the material 34. In a particularly preferred embodiment, the indicating material 34 is a zinc-sulfide phosphorescent material such as Glow Bright 7510 material obtained from Jessup Manufacturing of McHenry, Ill. The indicating material 34 also includes indicia 36 printed or otherwise applied to the material 34 on an upper surface 37 of the upper member 28 opposite the lower member 30, so as to be visible from above. The indicia 36 preferably comprises a pair of lines indicating the proper path for the putter head 16 during a putting stroke, which can be a straight line, or which may be curved depending upon the particular putting style of the individual. Indicia 36 can also have other lines optionally included, such as a line 37*a* illustrating the proper placement of the golf ball 18 on the upper member 28 of the pad 24, lines (not shown) illustrating how far to move the putter head 16 from the initial setup position to cause the golf ball 18 when struck to roll a certain specified or desired distance, or other types of indicia.

Looking now at FIGS. 2, 3, 5 and 6, the indicator 26 includes a simple securing device 38 that is capable of securing the indicator 26 to the putter head 16 opposite the ball striking surface 20. The indicator 26 is secured to the putter head 16 in a manner in which indicator 26 is in a desired orientation, preferably perpendicular, with respect to the upper member 28 of the pad 24 in order to provide an accurate representation on the indicating material 34 of the path of the putter head 16 over the pad 24. Thus, the securing device 38 can take the form of a spring clamp, double-sided tape, a magnet, an adhesive putty, or other suitable securing member in order to secure the indicator 26 to the putter head 16 in the proper orientation.

The indicator 26 itself can be any type of indicator capable of interacting with or energizing the indicating material 34 of the pad 24 in order to provide a visual representation of the path of the putter head 16 over the pad 24. In a particularly preferred embodiment, the indicator 26 takes the form of a light source 40 which emits a beam of light 42 that, upon striking the indicating material 34, causes the material 34 to react and form a visual representation of the path of the putter head 16 thereover. The light source 40 can be any suitable light source for reacting with the indicating material 34, but is preferably an LED light 44 that is secured within a housing 46. The housing 46 also encloses a suitable power source (not shown) such as a replaceable battery, and a switch 50 that selectively connects the power source with the light 44, such that the light 44 can be activated and deactivated as necessary. The size of the housing 46 is kept relatively small in order that when the housing 46 is secured to the putter head 16 by the securing device 38, the housing 46 does not interfere with the putting stroke made by the individual to maintain the accurate appearance and feel to the putting stroke.

With respect to the particular type of light 44 utilized with the light source 40, the particular form of the indicating material 34 will dictate the type or wavelength of light 44 that can be utilized. More specifically, the frequency of the light beam 42 emitted from the light 44 must be higher than the frequency of light required to energize or charge the phosphorescent or luminescent material contained within the indicating material 34. In a preferred embodiment, the light 44 emits a beam 42 with a wavelength of less than about 500 nanometers. In a particular preferred embodiment, the light 44 is a Blue T-1¾ (5 mm) LED light obtained from The LEDLight.com of Fallon, Nev. which has a 465 nanometer wavelength with a luminous intensity of 4.4 candellas. Further, in order to provide a sharper representation of the putting stroke on the pad 24, the housing 46 might also include an optional focusing lens 52 in front or behind the light 44 to direct the light beam 42 onto a smaller spot on the indicating material 34, thereby providing a more clear and focused representation of the putting stroke.

Figure 7:
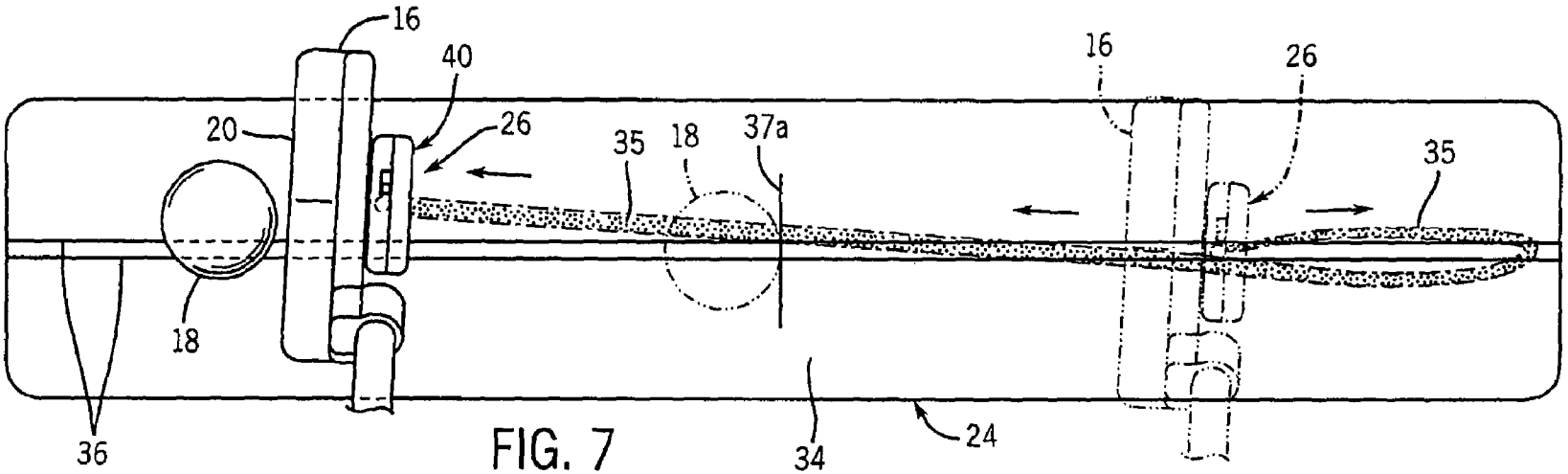
FIG. 7 is a view similar to FIG. 3, showing a comparison of the path of an actual swing relative to a desired swing path using the golf swing training aid of the present invention.

Having described the construction of the training aid 22, the use of the training aid 22 will now be discussed. When using the aid 22, first the pad 24 is positioned on a relatively flat surface, such as a floor, with the indicating material 34 placed in an upwardly facing position. If desired, the golf ball 18 is then positioned on the pad 24 in the proper location as identified by the line 37*a* on the indicating material 34. The indicator 26 is secured to the putter head 16 of the putter 10. In many cases, however, golf ball 18 is not used and indicator 26 is secured to the flat front face of the putter 10 since many puffer styles do not have a flat rear surface to which indicator 10 can easily be secured. With putters of this type, indicator 26 may be secured to a curved or otherwise non-planar rear surface using a putty material that adheres to the curved putter surface and also to indicator 26. However, as shown, indicator 26 may be secured to putter 10 opposite the ball striking surface 20, utilizing the securing device 38. The indicator 26 is secured to the putter head 16 such that the light beam 42 emitted by the light source 40 is directly in line with the desired ball-striking area of the striking surface 20 of the putter head 16, which is typically the center of striking surface 20. Indicator 26 is further positioned so as to strike the indicating material 34 in a generally perpendicular fashion as the putter head 16 moves through a putting stroke over the pad 24. When it is desired to operate the light source 40, the switch 50 is activated to emit the light beam 42 from the light 44. The individual can then line up the putter head 16 over and between the indicia lines 36, which may be behind the golf ball 18 if ball 18 is used, in a proper address position and proceed to take a putting stroke whereby the putter head 16 is moved rearwardly and forwardly in a pendulum-type manner. If golf ball 18 is used, putter head 16 contacts the golf ball 18 resting on the pad 24 as the putter head 16 is swung forwardly. As the putter head 16 moves back and forth across the pad 24, the light beam 42 from the indicator 26 strikes and energizes the indicating material 34 on the pad 24, causing the indicating material 34 to "glow" as the light beam 42 passes over the pad 24. After the completion of the putting stroke, the indicating material 34 provides a temporary visual representation 35 of the path of the putter head 16 on the pad 24, thereby showing the individual the path of the actual putting stroke. This representation of the path can then be compared with the indicia 36 on the indicating material 34 illustrating the proper putting stroke path, such that the individual can determine how close the actual putting stroke was to the proper putting stroke. FIG. 3 shows the temporary visual representation 35 in line with the indicia 36, indicating a proper swing. FIG. 7 shows the temporary visual representation 35 out of alignment with the indicia 36, indicating that the actual path of the swing varied from the desired path represented by indicia 36, thus leading to an improper strike of golf ball 18. After the user has compared the actual path to the proper path, the visual representation 35 on the indicating material 34 fades as the material 34 becomes de-energized, thus allowing the indicating material 34 to form a subsequent visual representation 35 of an actual putting stroke path in response to the light beam 42 striking the indicating material 34 during a subsequent putting stroke. The user can thus practice the putting stroke repeatedly, to create the desired muscle memory for use when putting during an actual golf game.

The training aid 22 can be utilized in this manner for a large number of putting strokes, because the pad 24, and specifically the indicating material 34 can be successively de-energized and re-energized by the light beam 42 almost indefinitely. Furthermore, in order to maximize the visual representation 35 of the actual putting stroke on the pad 24, the training aid 22 should be utilized in a low light condition where the indicia 36 is still easily viewable on the pad 24, but such that the visual representation 35 created by the indicator 26 moving over the pad 24 is easily viewable in contrast to the indicia 36.

While the previous discussion clearly illustrates the best mode currently contemplated of practicing the present invention, other alternative constructions are also contemplated. More specifically, the present invention contemplates any embodiment in which an indicator 26 securable to the putter head 16 is capable of interacting with the indicating material 34 in a manner that temporarily represents the path of the putter head 16 over the indicating material 34. Also, while the preferred interaction does not involve direct contact of the indicator 26 with the indicating material 34, a small amount of contact between the two items which does not impede the putting stroke is acceptable as well. For example, the indicating material 34 could be heat-sensitive material that locally changes color when contacted by a heat source, and the indicator 26 could be formed as a small heat source capable of being attached to the putter heat 16 and moved over the heat-sensitive indicating material 34. Further, the indicator 26 could be formed as a dry erase marker (not shown) or similar writing implement. When the indicator 26 in this embodiment is secured to the putter head 16, the putting stroke causes the indicator 26 to scribe a line (not shown) representative of the putter head 16 path on the indicating material 34. In addition, while the present invention has been shown as including an indicator that is removably attached to a putter head, it is also contemplated that the putter head may be formed with an internal light source that emits a light beam through on opening or the like. Further, while the invention is well suited for use in practicing a putting swing, it is also contemplated that the invention may be used to trace the movement of any type of golf swing, and is not limited to a putting swing. While the invention as described is well suited for tracking a putting swing due to the slow movement of the golf club, it is contemplated that the same theory as described may be used to track any type of swing. In addition, it is also understood that the present invention may be used with or without the reference indicia on the pad or other structure that supports the golf ball.

Various alternatives are contemplated as being with the scope of the following claims, particularly pointing out and distinctly claiming a subject matter regarded as a the invention.

We claim:

1. A method for practicing a golf swing using a golf club, the method comprising the acts of:

placing a golf ball on a support surface that includes an indicating material;

interconnecting a light source with the golf club;

activating the light source;

subsequently swinging the golf club toward the golf ball such that the light source passes over the support surface;

wherein the indicating material and the light source interact with each other to provide a visual representation of the path of the golf club as the golf club is moved toward the golf ball;

comparing the visual representation of the path with indicia disposed on the support surface, wherein the indicia represents a desired path of movement of the golf club;

removing the visual representation on the support surface after comparing the visual representation with the indicia; and moving the golf club and light source over the indicating material to form a subsequent visual representation on the support surface.

2. The method of claim 1, wherein the support surface is defined by a pad and wherein the indicating material is associated with the pad.

3. The method of claim 1, wherein the act of interconnecting a light source with the golf club is carried out by providing a light source that is separate from the golf club and mounting the light source to the golf club.

4. The method of claim 1 wherein the step of removing the visual representation comprises allowing the visual representation to fade away.

5. A method of detecting the path of a swung object, comprising the acts of:

interconnecting a light emitter with the swung object;

placing a light-sensitive material in the vicinity of a desired path of motion of the swing object;

swinging the object over the light-sensitive material, wherein movement of the light emitter over the light-sensitive material illuminates a path on the light sensitive material that corresponds to movement of the object over the light-sensitive material; and observing the illuminated path on the light-sensitive material.

6. The method of claim 5, wherein the swung object comprises the head of a golf club.

7. The method of claim 6, wherein the light-sensitive material includes indicia representing a desired path of movement of the golf club, and wherein the act of observing the illuminated path on the light-sensitive material includes comparing the illuminated path to the desired path.

* * * * *